United States Patent [19]

Rambach

[11] 3,945,567

[45] Mar. 23, 1976

[54] SNOW MAKING APPARATUS

[76] Inventor: Gerry Rambach, P.O. Box 213, Franconia, N.H. 03580

[22] Filed: July 17, 1975

[21] Appl. No.: 596,961

[52] U.S. Cl. ..... 239/14; 239/132.5; 239/419.5

[51] Int. Cl.[2] ..... F25C 3/04

[58] Field of Search ..... 239/2.5, 14, 128, 132.5, 239/407, 417.5, 419.5, 422, 416.5, 424.5, 425.5, 427.3, 428, 428.5, 430, 433; 62/74

[56] References Cited

UNITED STATES PATENTS

| | | | |
|---|---|---|---|
| 3,494,559 | 2/1970 | Skinner | 239/14 X |
| 3,733,029 | 5/1973 | Eustis et al. | 239/14 |
| 3,760,598 | 9/1973 | Jakob et al. | 239/2.5 X |

FOREIGN PATENTS OR APPLICATIONS

| | | | |
|---|---|---|---|
| 1,372,024 | 8/1964 | France | 239/2.5 |

*Primary Examiner*—Evon C. Blunk
*Assistant Examiner*—Andres Kashnikow
*Attorney, Agent, or Firm*—Robert F. O'Connell

[57] ABSTRACT

A snow-making system having a relatively large number of remotely located snow-making devices supplied with compressed air and pressurized water from sources thereof at a generally centralized location. Each device includes a compressed air driven motor for driving impeller blades which move external air at ambient, below freezing, temperatures through the device. Each device further includes means for mixing compressed air and pressurized water which mixture is combined with exhaust air from the air motor, such combination thereupon being further combined with the external air, the latter combination thereupon exiting from one end of the device. The exiting combination comes into contact with a spray of pressurized water at a location external to the device which contact produces nucleated particles which fall to the ground as artifically produced snow. Each snow-making device can operate generally at ambient temperatures as low as about 26°F and each is sufficiently mobile to permit it to be moved relatively easily from one ski slope location to another, even where such slopes are relatively steep.

23 Claims, 5 Drawing Figures

SNOW MAKING APPARATUS

INTRODUCTION

This invention relates generally to snow-making apparatus and, more particularly, to such apparatus utilizing air impeller blades driven by a rotary powered air motor.

BACKGROUND OF THE INVENTION

In order to assure adequate skiing in most areas of the world over an extended ski season, many such areas cannot fully rely upon natural snow to provide an adequate snow cover for such purpose. Consequently, apparatus and methods for making artificial snow are required both in the United States and in other countries to insure a profitable skiing season for many, if not most, operators of ski areas.

At the present time, two principal systems for making artificial snow are in use. The first such system, often referred to as an "air" system, utilizes a relatively large air compressor which is located at a centralized position (e.g. at the bottom of one or more ski slopes) and which provides compressed air fed through appropriate pipes to one or more remote locations of the ski area. Water under pressure is also supplied to such remote locations from a central water source which may, for example, be located near the air compressor. The compressed air and pressurized water are fed to appropriate "snow guns" which merely mix the two components in various ways to provide artificial snow. Such systems are relatively expensive to install and operate. The compressors must be quite large if they are to provide a sufficient supply of compressed air at more than a few locations.

In such air systems, the air flow rates at each gun may vary depending on the size of the guns that are being used, such air flow rates ranging from as low as about 100 cubic feet per minute (c.f.m.) to as high as 1,800–2,000 c.f.m., for example. Even at the relatively high end of the range of air flow rates, relatively little water is converted into snow despite the relatively large amount of air that is compressed for such purpose. Moreover, such installations are very costly to install and to operate. A known system, for example, which utilizes two relatively large air compressors, supplying a total combined output of 6,000 c.f.m. of compressed air to only three remotely located snow guns, can provide relatively little snow even at these few locations at any one time. The installation costs of such a system may well run as high as $200,000.00 or more, which represents a large investment with less return than is desirable to make the use thereof economically justifiable.

One advantage of using such conventional compressed air systems however, is that their operation can produce artificial snow at relatively high ambient temperatures i.e., at temperatures, which while below subfreezing, are generally about or above 26° F, as compared with other "airless" artificial snow making systems discussed below which usually require temperatures lower than about 26° F for providing adequate snow-making performance. Accordingly, such compressed air systems are generally found necessary for use in ski areas where the average mean temperature even in the cold months is generally higher than 26° F.

Another system which has been utilized in many ski areas is often referred to as an "airless" system wherein a plurality of snow-making units located at a plurality of remote locations of a ski area each use either internal combustion motors or electric motors to drive air propellers associated therewith to produce a cold air stream at each snow-making unit. Water from a centralized source is piped under pressure to each of such locations and suitable snow guns provide an appropriate mixture of the water with a cold air stream created by the propellers to produce artificial snow. While the system tends to provide for conversion of larger amounts of water to snow than the "air" systems as described above and eliminates the high cost of installing a relatively large central air compressor, each of the individual air propeller and motor units at the remote locations are in themselves relatively expensive. Moreover, appropriate electrical power, for example, must be supplied to each unit when electrical motors are used, requiring the laying of a large number of cables over the ski area. Such systems are considered relatively dangerous where high voltage industrial electric sources must be used, particularly at night under adverse conditions. Moreover, the relatively large size and overall weight of such motor units makes them cumbersome to move from one remote location to another as well as making it difficult to position them in a stable manner on relatively steep slopes. A further and significant disadvantage of such systems, which do not use compressed air is that they are not as effective at temperatures at or above about 26° F as are conventional "air" systems which are presently available.

SUMMARY OF THE INVENTION

This invention provides a system using one or more novel devices for making snow each of which utilizes compressed air in a manner which reduces the overall manufacturing, installation and operating costs of the system while still retaining the advantages of operation at relatively high average mean temperatures (i.e., about 26° F). The system of the invention avoids the need for electric or internal combustion motors and the consequent expense and potential dangers associated therewith. Moreover, the overall size and weight of the devices is such that they are more mobile than previously used "airless" motors and permits them to be useable even on relatively steep slopes.

In accordance with the invention, a snow-making device which includes a rotary air motor is utilized at each of a plurality of remote locations in a ski area where snow is to be made. The air motor is actuated by a compressed gas, such as air, from a centralized compressed air source for driving axial-flow, air impeller blades which draw external air at ambient temperature and pressure through the device so as to create a flow of sub-freezing air within the device. Exhaust air from the air motor is directed to a means within the device for combining the exhaust air with a previously formed mixture of compressed air and pressurized water, the exhaust air thereby aiding in the diffusion and atomization of the air/water mixture into a combined stream of droplets which are relatively small. When such combined stream enters into the flow of sub-freezing air stream created by the impeller blades, the overall combination is directed outwardly from the device where it is further contacted by a spray of pressurized water at the output end of the device, the pressurized water being thereupon converted into snow which then falls to the ground as an appropriate snow cover.

In a preferred embodiment, the air motor, the air/water mixing means and the means for combining the various components to form the output from the device are housed within a single housing, such as a clyindrical body, which also houses the impeller fan blades to form a snow-making unit the overall operation of which is effective and efficient even at temperatures at or above about 26° F. Such devices are located at a plurality of remote locations and are supplied with compressed air and pressurized water from sources which can be centrally located with respect thereto. The devices are light in weight and are highly mobile and relatively easy to manipulate even on steep ski slopes. Elimination of the use of the need for an electrical energy source removes the potential dangers that occur therefrom and such devices are readily adaptable for use in present systems having centralized compressed air sources already installed. By the use of such unique devices in accordance with the invention, the number of remote locations that can be serviced with a single centralized air compressor (and, hence, the total amount of artificial snow that can be produced) is increased considerably over present "air" systems so that the overall costs of the system in terms of the output snow produced is considerably reduced.

The invention can be described in more detail with the help of the accompanying drawings wherein FIG. 1 shows an overall block diagram of a system in accordance with the invention;

Figure 1:
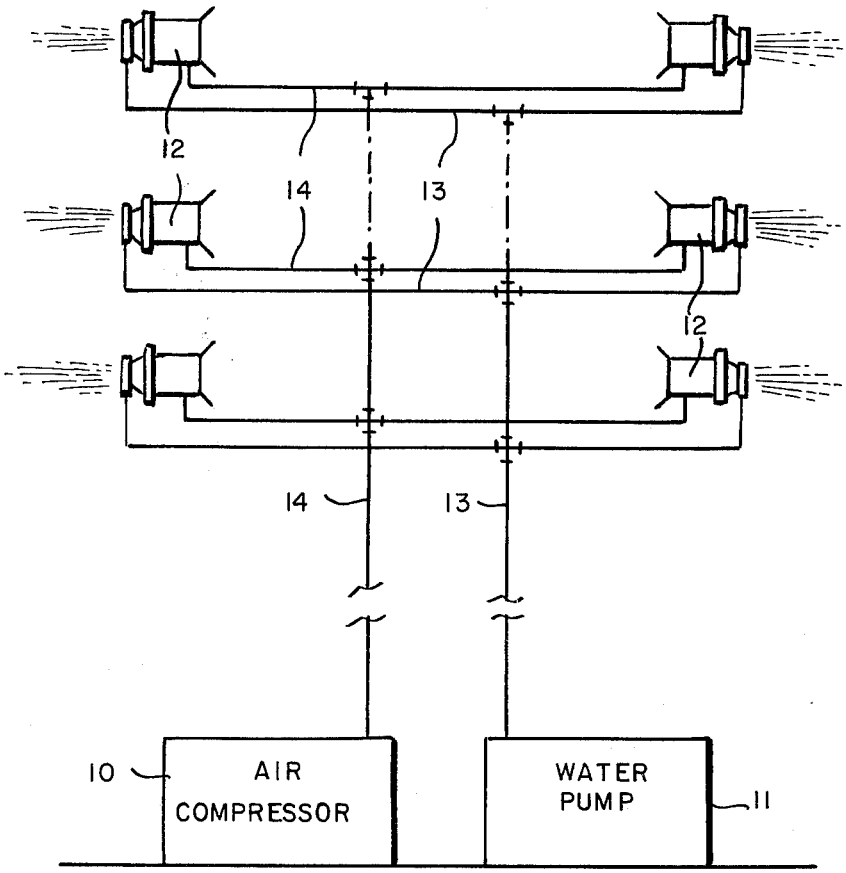

The system of the invention is shown in simplified block diagram form in FIG. 1, wherein a centralized source of compressed air 10 and a centralized water pump source 11 of pressurized water are both located at an appropriate region of a ski area, as at the bottom of one or more ski slopes thereof. A plurality of snow making devices 12 are located at a relatively large number of selected locations on one or more ski slopes where it is desirable to provide a new artificial ground snow cover or to supplement the natural snow cover which may already be present. Each of the remote located devices 12 is supplied with water under pressure from water pump source 11, via water pipe lines 13 such water being supplied at a pressure of about 250 psi for example. Compressed air under pressure of about 70 psi, for example is supplied from compressed air source 10 via appropriate air pipe lines 14, to each of said remotely located devices.

Figure 2:
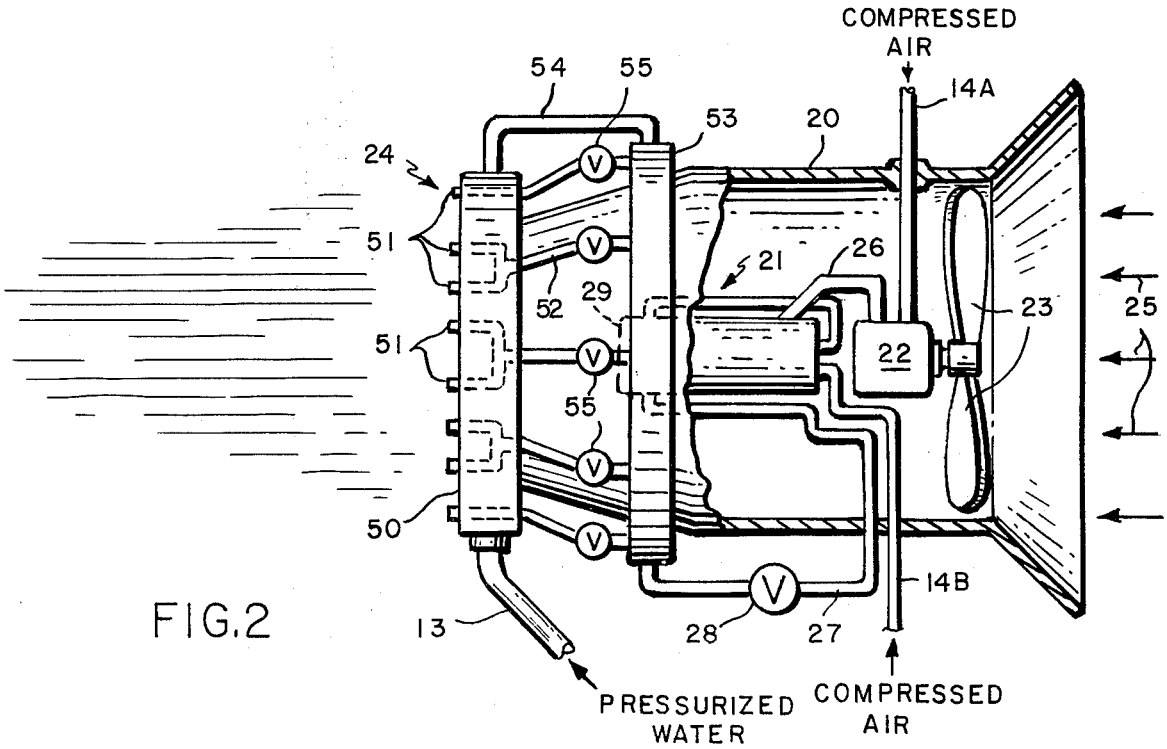
FIG. 2 depicts a view partially in section of the snow making units including the exhaust gun, air motor, and air impeller blades used at each remote location of the system in FIG. 1.

An exemplary snow making device at each such location is depicted in FIG. 2 and, as can be seen therein in a preferred embodiment, the device comprises a cylindrical housing 20 having mounted therein an exhaust gun 21, an air motor 22 which drives a plurality of air impeller blades 23 mounted at the rear, or input, end of housing 20 and a water spray unit 24 mounted at the front end, or output, of housing 20. Water from the centralized source 10 is supplied thereto via one of the water pipe lines 13, a portion of which is shown in FIG. 2. Compressed air from centralized compressed air source 11 is supplied via one of the air pipe lines 14 to two points at the device via suitable branch members 14A and 14B shown in FIG. 2. Thus, compressed air is fed via one input branch pipe line 14A to air motor 22, the latter being, for example, a motor of the type sold together with fan blades in an appropriate housing by Strobic Air Corporation of Trenton, N.J. under its trade designation as an explosion-proof fan.

Figure 3:
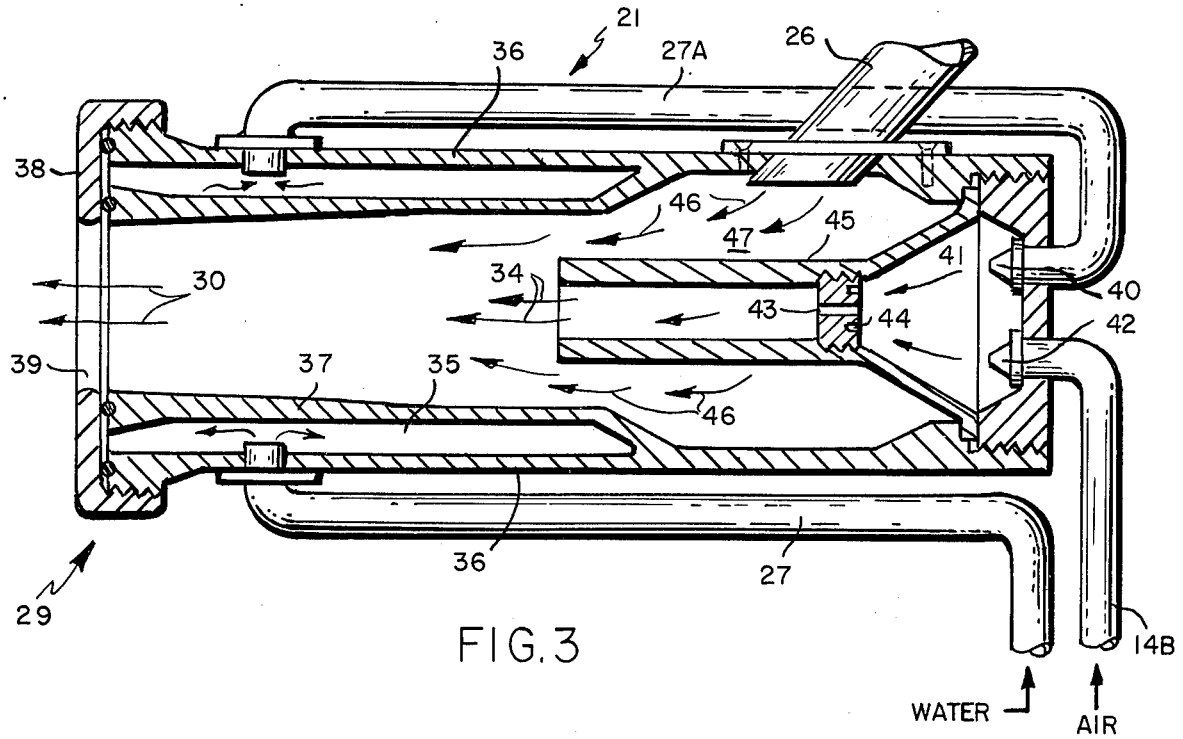
FIG. 3 is a view partially in section of a portion of the exhaust gun member of the unit shown in FIG. 1.
Figure 5:
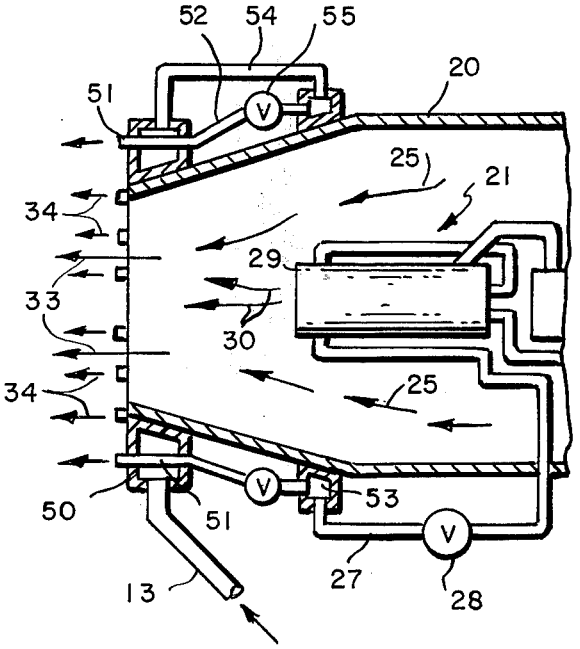
FIG. 5 is a view partially in section of the forward portion of the unit shown in FIG. 1.

Air motor 22 thereupon causes impeller blades 23 to rotate at an appropriate speed, such as 2,000 r.p.m. for example, so as to create a cold air stream by drawing in air at ambient pressure and ambient temperature which is below freezing, and causing said air to flow along the direction of arrows 25 through the device to the left thereof in the view shown in FIG. 2. The compressed air, after flowing through the air motor 22, exhausts from the air motor by way of exhaust pipe 26 which carries the exhaust air into an exhaust gun 21 for use therein as described in more detail below with reference to FIG. 3. Pressurized water is also supplied to exhaust gun 21 via water line 27. The flow therein being controlled by a valve 28 shown in FIG. 2. For efficient operation, the valve may be set to provide a relatively large flow thereof, up to as high as 70 gallons per minute (gpm), for example. The exhaust gun 21 provides a combined stream of exhaust air and a compressed air/water pressurized mixture, as described below, at its output end 29, as shown by arrow 20 (best seen in FIGS. 3 and 5). The combined stream 30 ultimately exits from the front end of the housing 20 at which end it generally enters the central portion of the air stream 25 created by the air impeller blades 23 (See FIG. 5) to form an overall output stream 33 from the device. A spray of water from a water spray means 24 positioned at the front end of the overall device enters the periphery of output stream 33, thereby becoming diffused both in the forward current of the sub-freezing air stream 25 created by air impeller blades 23 and in the forward projected current of the exhaust air and compressed air/pressurized water combination provided by the stream 30 from exhaust gun 21. Nucleation takes place external to the unit near the front end thereof so that the water particles then fall as snow onto the ground to form an appropriate artificial snow cover. The operation and structure of the exhaust gun is shown in more detail in FIG. 3.

Thus, water originating from the main water pipe line 13 is ultimately conveyed through pipe lines 27 and control valve 28 (see FIG. 2) so as to enter the front section of exhaust gun 21 into a jacket or chamber 35, formed by the external tubular section 36 and an internal generally tubular section 37 extending partially backward, for example, toward the rear end of exhaust gun 21. Inner tubular member 37 thereby forms an effective barrel for controlling the projection of exiting fluids while chamber 35 forms a water jacket around the barrel to maintain the discharge orifice 30 thereof at a sufficiently high level to prevent any ice formation thereof.

The water in chamber 35 exits therefrom via pipe line 27A extending into chamber 35 at an opening in tubular member 36 and flows to a nozzle 40 mounted at the opposite end of exhaust gun 21. Nozzle 40 directs the water into a mixing chamber 41 where it mixes with compressed air fed thereto via nozzle 42 supplied from an input pipe line 14B from the centralized air compressor. The compressed air which reaches chamber 41 may be at a pressure of about 70 psi, for example. The water and air entering chamber 41 from nozzles 40 and 42, respectively, thereupon become mixed and exist therefrom via an orifice 43 in plate 44 into a tube 45 formed as an extension of mixing chamber 41. Tube 45 extends generally to the central region of exhaust gun 21 into inner tubular member 37 so as to convey the compressed air and pressurized water mixture 34 therethrough.

Exhaust air from air motor 22 is supplied to exhaust gun 21 via exhaust pipe 26 and enters into a region 47 from which region it is conveyed into the interior of inner tubular member 37 as shown by arrows 46. The compressed air/pressurized watermixture 34 from tube 45 thereupon joins the exhaust air from air motor 22 within inner tubular member 37 to form a combined stream 30 thereof which exits from opening 39 formed, for example, by a cap member 38.

The exhaust pipe 25 is placed at a position sufficiently remote from the exit end of tube 45 so that the highly pressurized air and water mixture from tube 45 (at an air pressure, for example, of about 70 psi and at a water pressure, for example, of 250 psi) will draw forward the lesser pressurized exhaust air (at a pressure, for example, of less than 70 psi) in a venturi-like fashion. Such operation decreases the back pressure of the exiting air from the air motor and serves to increase the operating efficiency of the air motor. The combined stream 30 which contains the higher pressurized air/water combination from tube 45 and the lower pressurized exhaust air from the air motor 22 exits from opening 39 at the output end of exhaust gun 21. Such stream thereupon joins the sub-freezing air in cylinder 20 (see FIG. 5) which flows therethrough from the operation of the impeller blades 31 to form an overall mixture 33 thereof as discussed above.

Figure 4:
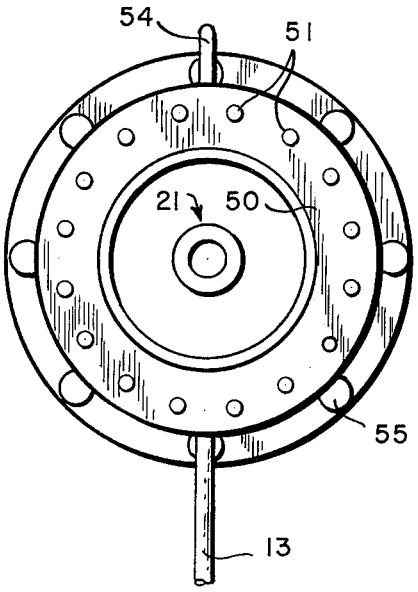
FIG. 4 is a front end view of the unit depicted in FIG. 1.

The overall mixture 33 exits from the output end of the device (See FIGS. 1 and 5) where it thereupon comes into contact with the water sprayed from nozzles 51 of water spray means 24, as shown by arrows 34 (FIG. 5), generally externally to the device. The water spray means is shown in more detail in FIGS. 2 and 4 where, as can be seen therein, the water from pipe line 13 from the centralized water pump source 11 is fed into a generally circular chamber 50 at a relatively high pressure (as high as 250 psi, for example), chamber 50 being generally annularly shaped and mounted at the front end of the housing 20. Water circulating in chamber 50 comes into contact with a plurality of spray nozzles 51 and in effect maintains the temperature of such nozzles at a level above freezing so as to prevent clogging thereof by the formation of ice thereon. The nozzles are supplied with water from a plurality of pipes 52 connected to a second chamber 53, displaced from chamber 50 and having a correspondingly circular configuration, such water being supplied to the input ends thereof via pipe line 54 from chamber 50. The pressure at which the water is fed to the water spray nozzles can be suitably controlled by valves 55. Water in chamber 53 is thereupon fed to pipe line 27 for use in the exhaust gun 21, as described above.

Thus, the water conveyed to spray nozzles 51 is at a relatively high pressure so that, as it comes into contact with the pressurized overall combined stream 33 from the output end of chamber 20, it becomes diffused both in the forward current of the sub-freezing air stream created by impeller blades 23 and in the forward projected current of the combined stream of exhaust air and pressurized air/water mixture from the exhaust gun and appropriate nucleation of the water particles takes place outside of the unit and falls to the ground as snow.

I claim:

1. A device for making artificial snow comprising means responsive to compressed air supplied thereto for moving air external to said device through said device from an input to an output thereof, said external air being at ambient temperature and pressure, and said air moving means further having exhaust air produced therefrom;

means responsive to compressed air supplied thereto and to water supplied under pressure thereto for forming a mixture of said compressed air and said pressurized water;

first means responsive to said mixture and to said exhaust air for combining said mixture and said exhaust air to form a combined stream thereof;

second means for further combining said stream with said external air moving through said device, the combination of said stream and said external air thereupon exiting from said device at said output thereof; and means responsive to water supplied under pressure thereto for producing a spray of pressurized water external to said device at said output thereof and for directing said spray into contact with the combination of said stream and said external air exiting from said device at said output to produce artificial snow.

2. A device in accordance with claim 1 wherein said air moving means includes one or more air impeller blades positioned near said input of said device; and an air motor responsive to compressed air supplied thereto for actuating said air impeller blades to move said external air through said device, said air motor having said exhaust air produced therefrom.

3. An apparatus in accordance with claim 2 wherein said mixture forming means comprises a mixing chamber;

a first nozzle means responsive to compressed air supplied thereto for directing said compressed air into said chamber; and a second nozzle means responsive to water supplied under pressure thereto for directing said pressurized water into said chamber, said compressed air and said pressurized water impinging upon one another within said chamber so as to form a mixture thereof in said chamber.

4. An apparatus in accordance with claim 3 wherein said mixture forming means further includes a channel means having a first opening in communication with said mixing chamber for re-receiving said mixture and a second opening for directing said mixture outwardly from said channel means into said first combining means for combining said mixture with said exhaust air.

5. An apparatus in accordance with claim 4 wherein said first combining means includes means at least partially enclosing the region where said mixture and said exhaust air are combined, said means receiving water supplied under pressure thereto for maintaining the temperature of said region at a level sufficiently high to prevent the formation of ice at the second opening of said channel means; and means for conveying said pressurized water from said enclosing means to said second nozzle means.

6. An apparatus in accordance with claim 5 wherein said pressurized water spray producing means is generally annularly-shaped and includes a plurality of nozzles positioned at the output of said device, the combination of said stream and said external air thereby exiting from said device through the opening formed by said annularly-shaped means.

7. An apparatus in accordance with claim 6 wherein said pressurized water spray producing means further includes a first annular chamber at the output of said device, said plurality of nozzles being mounted at said chamber, said chamber receiving water under pressure for maintaining the temperature of said plurality of nozzles at a level sufficiently high to prevent the formation of ice thereat.

8. An apparatus in accordance with claim 7 wherein said pressurized water spray producing device further includes a second annular chamber displaced from said first annular chamber;

means for supplying water under pressure from said first annular chamber to said second annular chamber; and means for conveying said pressurized water from said second annular chamber to said plurality of nozzles at said first annular chamber.

9. A system for producing artificial snow comprising a first source of compressed air;

a second source of pressurized water;

one or more snow making devices located at positions remote from said first and second sources;

means for supplying compressed air from said first source to said one or more snow making devices;

means for supplying pressurized water from said second source to said one or more snow making devices;

each of said snow making devices including means responsive to said compressed air for moving air external to said device through said device from an input to an output thereof, said external air being at ambient temperature and pressure, and said air moving means further having exhaust air produced therefrom;

means responsive to said compressed air and to said pressurized water for forming a mixture of said compressed air and said pressurized water;

first means responsive to said mixture and to said exhaust air for combining said exhaust air and said mixture to form a combined stream thereof;

second means for further combining said stream with said external air moving through said device, the combination of said stream and said external air exiting from said device at said location thereof; and means responsive to said pressurized water from said second source for producing a spray of said pressurized water external to said device at said output thereof and for directing said spray into contact with the combination of said stream and said external air exiting from said device at said output to produce artificial snow.

10. A system in accordance with claim 9 wherein said air moving means includes one or more air impeller blades positioned near said input of said device; and an air motor for activating said air impeller blades to move said external air through said device.

11. A system in accordance with claim 10 wherein said first source supplies said compressed air therefrom at a pressure within a range from about 70 psi to about 100 psi.

12. A system in accordance with claim 11 wherein said compressed air is supplied at a pressure of about 70 psi.

13. A system in accordance with claim 11 wherein said second source supplies water therefrom at a pressure within a range from about 250 psi to about 500 psi.

14. A system in accordance with claim 13 wherein said water is supplied at a pressure of about 250 psi.

15. A system in accordance with claim 10 wherein said mixture forming means comprises a mixing chamber;

a first nozzle means responsive to said compressed air for directing said compressed air into said chamber; and a second nozzle means responsive to said pressurized water for directing said pressurized water into said chamber, said compressed air and said pressurized water impinging upon one another within said chamber so as to form a mixture thereof in said chamber.

16. A system in accordance with claim 15 wherein said mixture forming means further includes a channel means having a first opening in communication with said mixing chamber for receiving said mixture and a second opening for directing said mixture outwardly from said channel means into said first combining means for combining said mixture with said exhaust air.

17. A system in accordance with claim 16 wherein said first combining means includes means at least partially enclosing the region where said mixture and said exhaust air are combined, said means receiving said pressurized water for maintaining the temperature of said region at a level sufficiently high to prevent the formation of ice at the second opening of said channel means; and means for conveying said pressurized water from said enclosing means to said second nozzle means.

18. A system in accordance with claim 17 wherein said compressed air is supplied to said first nozzle means at a pressure of about 70 psi and said pressurized water is supplied to said second nozzle means at a pressure of about 250 psi and said exhaust air is supplied to said first combining means at a pressure of about 50 psi.

19. A system in accordance with claim 17 wherein said pressurized water spray producing means is generally annularly-shaped and includes a plurality of nozzles positioned at the output of said device, the combination of said stream and said external air thereby exiting from said device through the opening formed by said annularly-shaped means.

20. A system in accordance with claim 19 wherein said pressurized water spray producing means further includes a first annular chamber at the output of said device, said plurality of nozzles being mounted at said chamber, said chamber receiving pressurized water for maintaining the temperature of said plurality of nozzles at a level sufficiently high to prevent the formation of ice thereat.

21. A system in accordance with claim 19 wherein said pressurized water spray supplying device further includes a second annular chamber displaced from said first annular chamber;

means for supplying pressurized water from said first annular chamber to said second annular chamber; and means for conveying said pressurized water from said second annular chamber to said plurality of nozzles at said first annular chamber.

22. A system in accordance with claim 21 wherein said pressurized water is supplied to said first chamber at a pressure of about 250 psi.

23. A system in accordance with claim 22 wherein said pressurized water conveying means includes control means for supplying sasid pressurized water to said plurality of nozzles at a pressure of about 250 psi.

* * * * *